US006296558B1

(12) United States Patent
Poole et al.

(10) Patent No.: US 6,296,558 B1
(45) Date of Patent: Oct. 2, 2001

(54) SANDING DEVICE

(76) Inventors: Daniel L. Poole, 3319 W. Malapai Dr., Phoenix, AZ (US) 85051; Robert N. Poole, P.O. Box 2898, Pinetop, AZ (US) 85935

( * ) Notice: Subject to any disclaimer, the term of this patent is extended or adjusted under 35 U.S.C. 154(b) by 0 days.

(21) Appl. No.: 09/311,026

(22) Filed: May 13, 1999

(51) Int. Cl.[7] ..... B24B 15/02
(52) U.S. Cl. ..... 451/557; 451/515; 451/525
(58) Field of Search ..... 451/557, 515, 451/525

(56) References Cited

U.S. PATENT DOCUMENTS

| | | | |
|---|---|---|---|
| 838,465 | 11/1906 | Seaborn . | |
| 840,982 | 1/1907 | Williams . | |
| 1,175,245 | 3/1916 | Dennis . | |
| 2,482,344 | 9/1949 | Kent . | |
| 2,493,505 | 1/1950 | Schueller . | |
| 2,527,089 | 10/1950 | Adams . | |
| 2,560,008 * | 10/1951 | Steward | 451/515 |
| 2,680,334 | 6/1954 | Howard . | |
| 3,073,084 * | 1/1963 | Howard | 451/557 |
| 5,168,672 | 12/1992 | Gregoire, Sr. . | |

* cited by examiner

*Primary Examiner*—Joseph J. Hail, III
*Assistant Examiner*—George Nguyen
(74) *Attorney, Agent, or Firm*—Parsons & Goltry; Robert A. Parsons; Michael W. Goltry

(57) ABSTRACT

A sanding device for sanding substantially planar surfaces and substantially non-planar surfaces including a first section and a second section releasably coupled thereto. The second section for supporting a piece of sandpaper having ends captured between the engagement of the first and second sections. The first section also capable of being used for retaining sandpaper absent the second section.

6 Claims, 3 Drawing Sheets

FIG. 1
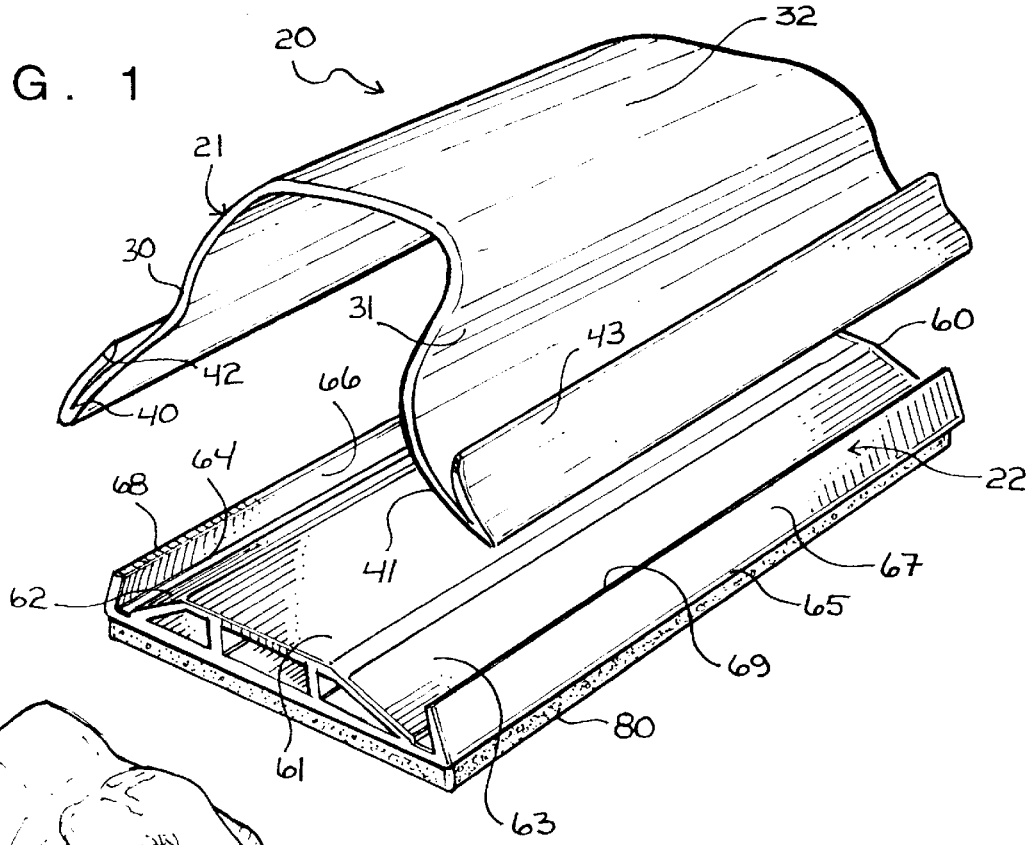
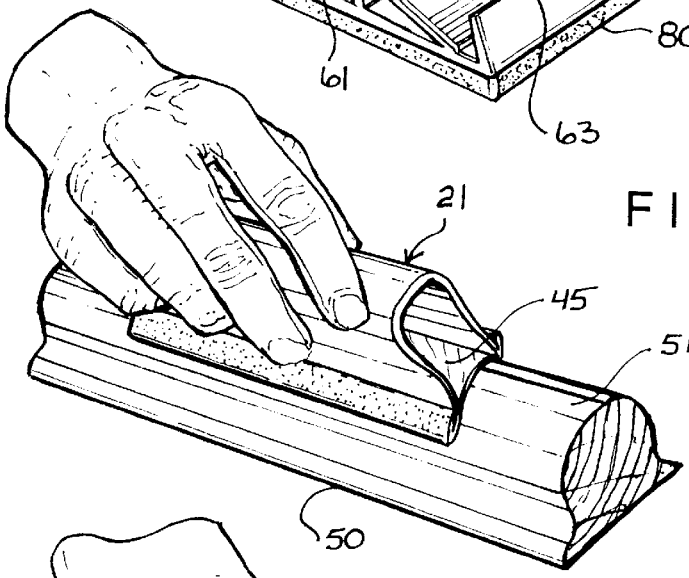
FIG. 2
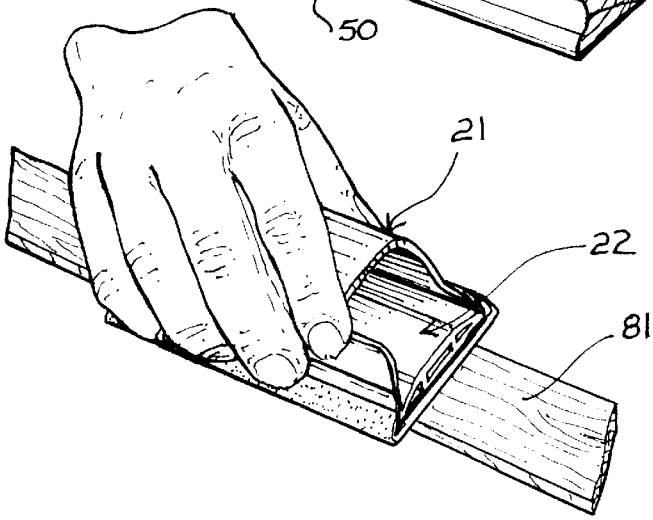
FIG. 3

FIG. 7
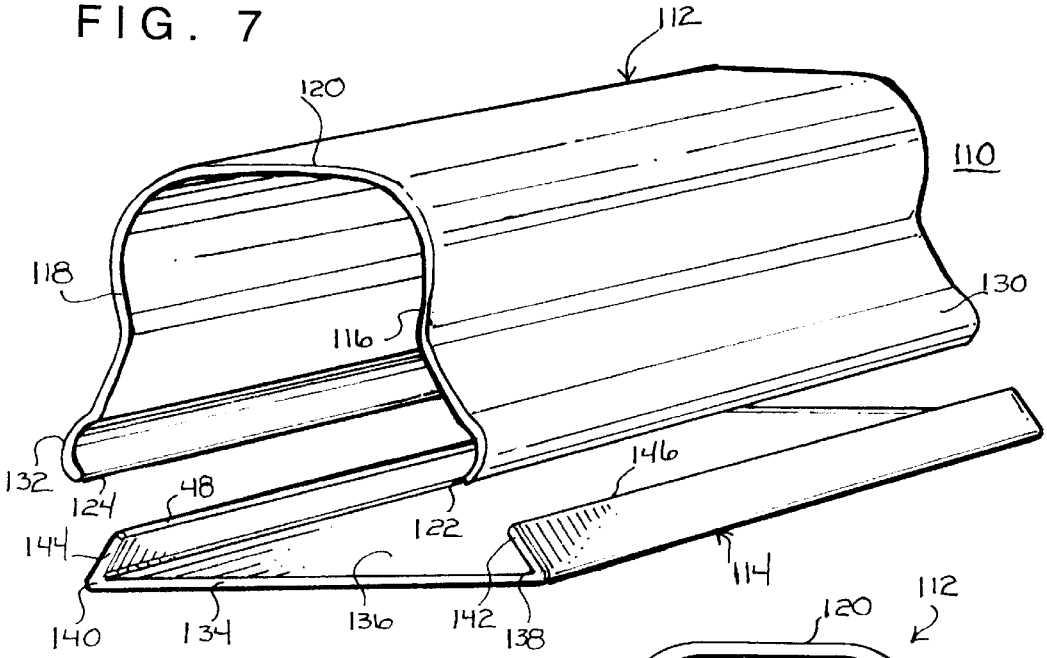
FIG. 8
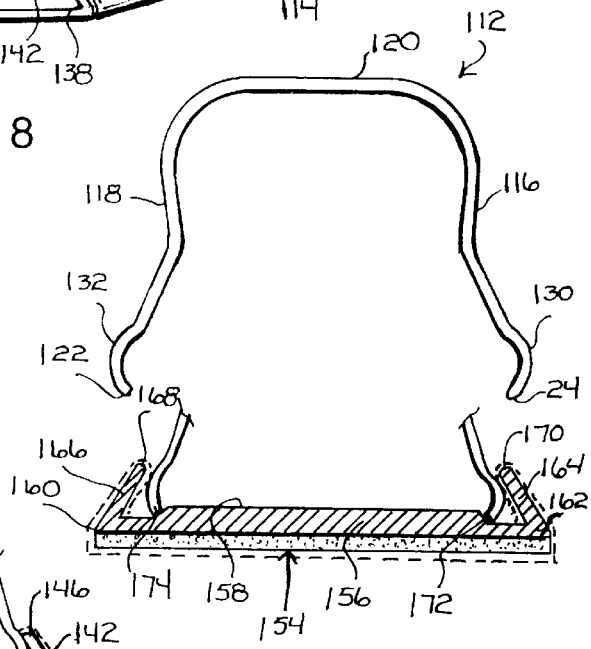
FIG. 9
FIG. 10
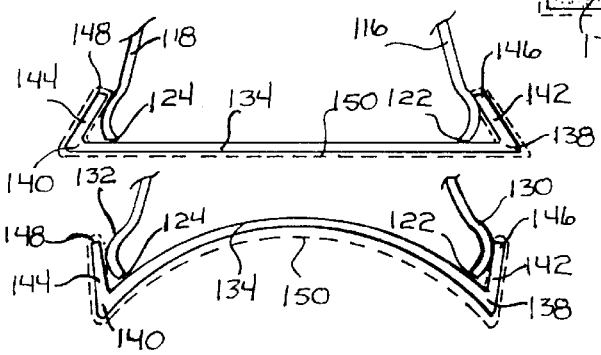
FIG. 11

SANDING DEVICE

FIELD OF THE INVENTION

This invention relates to sanding devices.

More particularly, the present invention relates to devices for retaining sandpaper during sanding procedures.

BACKGROUND OF THE INVENTION

Sandpaper is used in a wide variety of activities and on many materials. Woodworkers, auto body workers, painters etc. are among those who use sandpaper on wood, metal, wallboard and filler compounds to list a few. Small, curved or irregular shaped surfaces are typically sanded by holding the sandpaper in the hand. A human hand is capable of forming itself to the desired shape, or forcing the sandpaper into small areas. The problem is that the human hand does not provide a uniform and unvarying force because of a tendency to change shape due to its highly articulate nature. Also, it is often very difficult to adequately maintain a secure hold on a piece of sandpaper.

To overcome these problems, sanding blocks are commonly used. A sanding block generally has a planar surface over which the sandpaper is placed. An individual gripping the block also grips the edges of the sandpaper thereby holding the sandpaper in place. While generally effective for sanding planar surfaces, irregular, contoured or curved surfaces are still commonly sanded by hand, as a sanding block is ineffectual. Thus, the problem of applying a uniform and consistent force is still a problem.

It would be highly advantageous, therefore, to remedy the foregoing and other deficiencies inherent in the prior art.

Accordingly, it is an object of the present invention to provide a sanding device for securely holding sandpaper while sanding.

Another object of the present invention to provide a sanding device which is capable of uniformly and consistently sanding surfaces.

And another object of the present invention to provide a sanding device which can be employed to sand planar surfaces, curved surfaces, contoured surfaces, corners, etc.

Still another object of the present invention to provide a sanding device in which sandpaper is easily installed.

SUMMARY OF THE INVENTION

Briefly, to achieve the desired objects of the present invention in accordance with a preferred embodiment thereof, provided is a sanding device for retaining a piece of sand paper including a first section having the general shape of a channel including spaced apart sidewalls in a generally outwardly divergent and outwardly biased relationship. The sidewalls each terminate in an end and are movable between an inwardly compressed position and an outwardly biased position. A second section includes a base having a first surface, an opposing second surface, and spaced apart engagement members extending upwardly and inwardly convergent from the first surface for receiving the ends of the first section therebetween with the sidewalls in the inwardly compressed position and retaining the ends with the sidewalls in the outwardly biased position. Ends of the piece of sandpaper are receivable between respective ends of the first section and the engagement members and retained thereby with the sidewalls in the outwardly biased position.

In accordance with another embodiment, the ends of the sidewalls of the first section each include a sandpaper engagement element for receiving the ends of a piece of sandpaper in the inwardly compressed position and tautly retaining the sandpaper therebetween in the outwardly biased position in the absence of the second section. The sandpaper engagement elements are generally hook shaped to form an upwardly directed slot for receiving the end of the piece of sandpaper.

BRIEF DESCRIPTION OF THE DRAWINGS

The foregoing and further and more specific objects and advantages of the present invention will become readily apparent to those skilled in the art from the following detailed description of a preferred embodiment thereof taken in conjunction with the drawings, in which:

FIG. 1 is an exploded perspective view of a sanding device in accordance with the present invention;

FIG. 2 is a perspective view of a first sanding section of the device of FIG. 1 as it would appear being employed to sand a non-planar surface;

FIG. 3 is a perspective view of the device of FIG. 1 as it would appear being employed to sand a planar surface;

FIG. 7 is an exploded perspective view of another embodiment of a sanding device in accordance with the present invention;

FIG. 8 is a sectional end view of the first section of the sanding device of FIG. 7;

FIG. 9 is a sectional end view illustrating the first section engaging another embodiment of a second section and retaining sand paper thereon;

FIG. 10 is a section end view of the first section received by the second section of the sanding device of FIG. 7; and FIG. 11 is a sectional end view similar to FIG. 10, illustrating the flexibility of the second section.

DETAILED DESCRIPTION OF A PREFERRED EMBODIMENT

Figure 5:
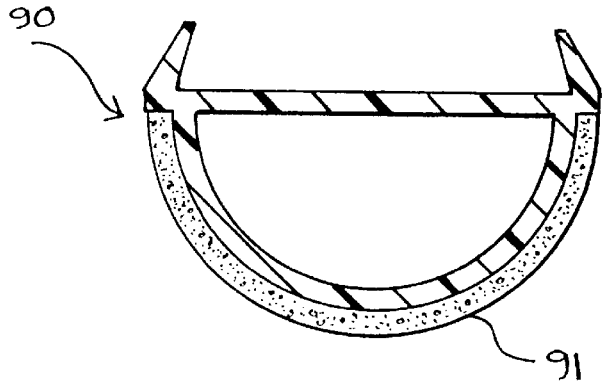
FIG. 5 is a sectional end view of another embodiment of a second sanding section.

Turning now to the drawings, in which like reference characters indicate corresponding elements throughout the several views, attention is first directed to FIG. 1 which illustrates a first embodiment of the instant invention comprising a sanding apparatus, being generally designated by the reference character 20, for sanding substantially planar surfaces and substantially non-planar surfaces. Sanding apparatus 20 is a modular apparatus generally comprised of a first sanding section 21 and a second sanding section 22 detachably engagable to said first sanding section 21. First sanding section 21 is operative for sanding irregular or substantially non-planar surfaces, and second sanding section 22 is operative for sanding substantially planar surfaces.

With continuing reference to FIG. 1, first sanding section 21 is preferably formed generally in the shape of a barrel vault or channel including a substantially elongate configuration having a pair of spaced-apart upstanding sidewalls, 30 and 31, interconnecting and supporting proximate upper ends thereof a substantially planar section 32. It will be understood that section 32 may be flat, curved, concave or substantially any other shape to coupled sidewalls 30 and 31. Sidewalls, 30 and 31, are flared or sloped somewhat outwardly in relation to each other in a generally outwardly divergent and biased relation and terminate with lower ends, 40 and 41, respectively, each having an engagement element, 42 and 43, respectively formed generally in the shape of a hook to form an upwardly directed slot for receiving the end of the piece of sandpaper. As can be seen in FIG. 1, lower ends, 40 and 41, are disposed in spaced-apart relation and define substantially parallel planes.

First sanding section 21 is preferably constructed of extruded plastic, stainless steel, or other suitable material having springy and shape memory characteristics providing for the outward bias. Apart from the general shape as described, first sanding section 21 may have various indentation and curves to fit more easily and comfortably in a users hand. With attention directed to FIG. 2, engagement elements, 42 and 43 are operative for detachably engaging a piece of sandpaper 45 for supporting the sandpaper 45 therebetween. In particular, a first edge of the sandpaper 45 can be placed within, and thereby detachably affixed thereto, engagement element 42 along substantially its entire length. Because first sanding element is constructed of a material having springy and shape memory characteristics, lower ends, 40 and 41, may be urged inwardly by a user after which a user may place a second edge of sandpaper 45 into engagement element 43 thereby detachably engaging the second edge of sandpaper 45 within engagement element 43. Upon release of first sanding section 21, sidewalls, 30 and 31, urge outwardly back to their original orientation whereby the sandpaper 45 is carried between the lower ends, 40 and 41, in a substantially taut configuration.

As can be seen in FIG. 2, first sanding section 21 having sandpaper 45 detachably coupled thereto is suitably operative for sanding a substantially non-planar surface. In particular, a piece 50 of wood is shown having a substantially arcuate outer surface 51. To sand arcuate outer surface 51 with first sanding section 21, a user need only grasp first sanding section 21 and urge sandpaper 45 against the substantially arcuate outer surface 51. Upon application of pressure against first sanding section 21, sidewalls, 30 and 31, urge inwardly toward each other as sandpaper 45 wraps around and engages substantially arcuate outer surface 51, whereby one may then sand substantially arcuate outer surface 51 by urging first sanding section 21 in a selected direction along the length of the piece 50 of wood. Because first sanding section 21 is flexible, sandpaper 45 will be free to conform itself to substantially non-planar surface including not only substantially arcuate surfaces but also other substantially irregular or contoured surfaces.

Figure 4:
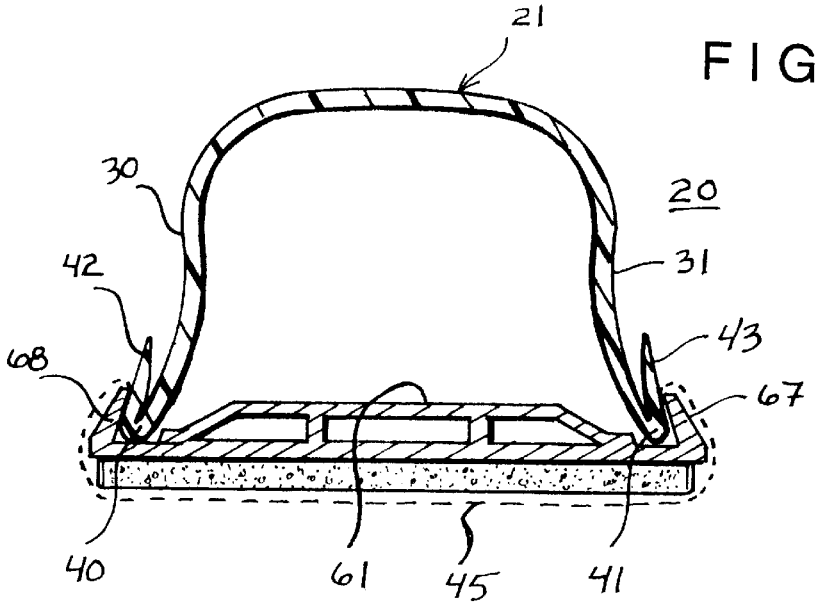
FIG. 4 is a sectional end view of the sanding device of FIG. 1 as it would appear retaining a sheet of sandpaper.

With attention directed back to FIG. 1 and with additional reference to FIG. 4, second sanding section 22 is generally comprised of a base 60 having a width somewhat less than the distance between the lower ends, 40 and 41, in which they normally reside. Base 60, preferably constructed of extruded plastic, wood, steel, or other selected material, includes a substantially planar lower surface (not shown), an upper surface 61 having spaced apart sloping surfaces, 62 and 63, terminating with side edges, 64 and 65, having upwardly and somewhat inwardly extending engagement members, 66 and 67, terminating with upper edges, 68 and 69.

Sidewalls, 30 and 31, may be urged somewhat inwardly and the lower ends, 40 and 41, inserted into engagement members, 66 and 67, respectively. Release of sidewalls, 30 and 31, will frictionally engage lower ends, 40 and 41, to engagement elements, 66 and 67, as sidewalls, 30 and 31, spring outwardly. The lower surface of base 60 can be covered with sandpaper 45 with opposing ends thereof curled over engagement elements 66 and 67. When lower ends 40 and 41 are inserted between engagement elements 66 and 67 as described previously, the ends of sandpaper 45 will be securely retained. In this manner, a substantially flat surface 81 (FIG. 3) may then be sanded. A sponge-like substance 80 may be provided on the substantially planar lower surface of base 60 if desired for facilitating ease and uniformity of sanding operations, but this is not essential.

Spaced-apart sloping surfaces, 62 and 63, are provided for keeping lower ends, 40 and 41, engaged to engagement members, 66 and 67, respectively during use thereof. In particular, as a user grasps first sanding section 21 and applies pressure to it for sanding a surface, sloping surfaces, 62 and 63, function to keep lower ends, 40 and 41, from being urged toward one another thereby becoming detached from base 60.

Figure 6:
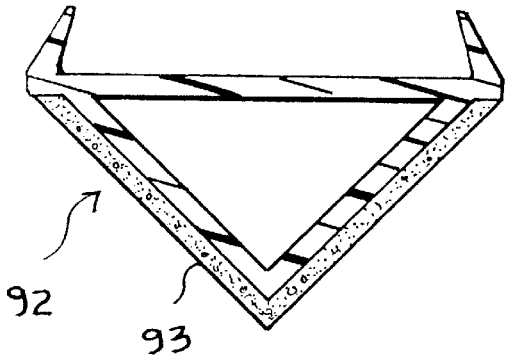
FIG. 6 is a sectional end view of yet another embodiment of a second sanding section.

Attention is now directed to FIG. 5 and FIG. 6, illustrating two alternate embodiments of a second sanding section being generally designated by the reference characters 90 and 92, respectively. Having the same elements as second sanding section 22 previously discussed, second sanding section 90 includes instead of a substantially planar lower surface like second sanding section 22, a substantially arcuate lower surface 91. As a result, second sanding section 90 may be used for sanding substantially concave surfaces or other similar surfaces suitable for sanding with substantially arcuate lower surface 91. In like manner, having the same elements as second sanding section 22 previously discussed, second sanding section 92 includes an substantially outwardly angled surface 93. As a result, second sanding section 92 may be used for sanding substantially inwardly angled surfaces or other similar surfaces suitable for sanding with substantially arcuate lower surface 91. It will be understood that arcuate lower surface 91 can be formed having substantially any desired radius. This is also the same for angled surface 93 which can be formed with any desired angle. Furthermore, other shapes can be employed as desired.

Turning now to FIG. 7, illustrated is another embodiment of the instant invention comprising sanding apparatus, being generally designated by the reference character 110, for sanding substantially planar surfaces and substantially non-planar surfaces. Sanding apparatus 110 is a modular apparatus generally comprised of a first section 112 and a second section 114 detachably engaged to said first section 112. First section 112 is operative as a gripping and sandpaper retaining member, while second section 114 receives and supports a sheet of sand paper (not shown).

With continuing reference to FIG. 7 and additional reference to FIG. 8, first section 112 is preferably formed generally in the shape of a barrel vault or channel including a substantially elongate configuration having a pair of spaced-apart upstanding sidewalls 116 and 118, interconnecting and supporting proximate upper ends thereof a substantially planar section 120. Sidewalls, 116 and 118, are flared or sloped somewhat outwardly in relation to each other in a generally outwardly divergent relation and terminate with lower ends 122 and 124. As can be seen in FIG. 7 and 8, lower ends 122 and 124 terminate in outwardly directed bulges having curved outer surfaces 130 and 132. First section 112 is preferably constructed of extruded plastic, stainless steel, or other suitable material having springy and shape memory characteristics. Thus, ends 122 and 124 are biased outwardly but can be compressed toward each other.

With attention directed back to FIG. 7, second section 114 is generally comprised of a base 134 having a width somewhat less than the distance between the lower ends 122 and 124 which are normally received therein. Base 134, preferably constructed of extruded plastic, wood, steel, or other selected material, includes a substantially planar lower surface (not shown), and an upper surface 136 terminating in outer edges 138 and 140. Engagement members 142 and 144 extend generally upwardly and somewhat inwardly from edges 138 and 140 respectively, terminating with upper edges 146 and 148.

Referring now to FIG. 10, a sheet of sandpaper 150 (shown as broken line) is wrapped around second section 114, overlying the lower surface of base 134 with edges of the sandpaper folded over upper edges 146 and 148 and terminating proximate upper surface 136. Sandpaper 150 is retained in position on second section 114 by first section 112. Ends 122 and 124 of first section 112 are forced slightly inwardly against their outward bias to permit their receipt between engagement members 142 and 144 of second section 114. When release, sidewalls 116 and 118 will flex outwardly forcing outer surfaces 130 and 132 outward against engagement members 142 and 144 and thereby catching and securely retaining the ends of sandpaper 150 therebetween.

Turning to FIG. 11, base 134 of second section 114 can be formed of a flexible material, permitting deformation around an object having a shape such as a radius. As second section 114 is deformed into a curve, engagement members 142 and 144 pivot around on outer surfaces 130 and 132. However, due to the curved shape of outer surfaces 130 and 132, pressure is always maintained against engagement members 142 and 144 and sandpaper 150. In this manner, sandpaper 150 is securely retained in position even when second section 114 is fully flexed.

Referring now to FIG. 9, another embodiment of a second section generally designated 154 is illustrated engaged with first section 112. Second section 154 is substantially identical to second section 114 including a base 156 having a width somewhat less than the distance between lower ends 122 and 124 which are normally received therein. Base 156, preferably constructed of extruded plastic, wood, steel, or other selected material, includes a substantially planar lower surface (not shown), and an upper surface 158 and terminates in outer edges 160 and 162. Engagement members 164 and 166 extend generally upwardly and somewhat inwardly from edges 160 and 162 respectively, terminating with upper edges 168 and 170. Second section 154 differs from second section 114 in that base 156 is substantially thicker and is substantially rigid in construction to prevent flexing and provide a planar surface and has a raised central portion of surface 158 to form abutments 172 and 174. Ends 122 and 124 engage abutments 172 and 174 to prevent sidewalls 116 and 118 from being inadvertently compressed during sanding procedures. Also, a pad 176 is attached to the planar lower surface of second section 154, although this can be omitted. It will be understood that a pad can also be affixed to second section 114. Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims:

What is claimed is:

1. A sanding device for retaining a piece of sand paper comprising:

a first section having the general shape of a channel including spaced apart sidewalls in a generally outwardly divergent and outwardly biased relationship, the sidewalls each terminating in an end and movable between an inwardly compressed position and an outwardly biased position; and a second section including a base having a first surface, an opposing second surface, and spaced apart engagement members extending upwardly and inwardly convergent from the first surface for receiving the ends of the first section therebetween with the sidewalls in the inwardly compressed position and retaining the ends with the sidewalls in the outwardly biased position, ends of the piece of sandpaper being receivable between respective ends of the first section and the engagement members and retained thereby with the sidewalls in the outwardly biased position, the base of the second section being substantially rigid and the first surface including abutments inwardly adjacent engagement members for receiving the ends of the sidewalls there against to prevent movement of the sidewalls to the inwardly compressed position during sanding procedures.

2. A sanding device as claimed in claim 1 wherein the ends of the sidewalls of the first section each include a sandpaper engagement element for receiving the edges of a piece of sandpaper in the inwardly compressed position and tautly retaining the sandpaper therebetween in the outwardly biased position in the absence of the second section.

3. A sanding device as claimed in claim 2 wherein the sandpaper engagement elements are generally hook shaped to form upwardly directed slots for receiving the edges of the piece of sandpaper.

4. A sanding device for sanding substantially planar surfaces and substantially non-planar surfaces comprising:

a first section having the general shape of a channel including spaced apart sidewalls in a generally outwardly divergent and outwardly biased relationship, the sidewalls each terminating in an end and movable between an inwardly compressed position and an outwardly biased position;

a second section including a base having a first surface, an opposing second surface, and spaced apart engagement members extending upwardly and inwardly convergent from the first surface for receiving the ends of the first section therebetween with the sidewalls in the inwardly compressed position and retaining the ends with the sidewalls in the outwardly biased position, the base of the second section being substantially rigid and the first surface including abutments inwardly adjacent engagement members for receiving the ends of the sidewalls there against to prevent movement of the sidewalls to the inwardly compressed position during sanding procedures; and a piece of sandpaper having opposing edges, the piece of sandpaper traversing the second surface of the base with the edges of the piece of sandpaper being received between respective ends of the first section and the engagement members and retained thereby with the sidewalls in the outwardly biased position.

5. A sanding device as claimed in claim 4 wherein the ends of the sidewalls of the first section each include a sandpaper engagement element receiving the edges of the piece of sandpaper in the inwardly compressed position and tautly retaining the sandpaper therebetween in the outwardly biased position in the absence of the second section.

6. A sanding device as claimed in claim 5 wherein the sandpaper engagement elements are generally hook shaped to form upwardly directed slots receiving the edges of the piece of sandpaper.

* * * * *